US008082623B2

(12) United States Patent
Scott

(10) Patent No.: US 8,082,623 B2
(45) Date of Patent: Dec. 27, 2011

(54) ACCESSIBLE VACUUM CLEANER FOR PERSONS WITH DISABILITIES

(75) Inventor: Timothy M. Scott, Lancaster, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 338 days.

(21) Appl. No.: 12/419,666

(22) Filed: Apr. 7, 2009

(65) Prior Publication Data

US 2009/0265879 A1 Oct. 29, 2009

Related U.S. Application Data

(60) Provisional application No. 61/047,255, filed on Apr. 23, 2008.

(51) Int. Cl.
*A47L 9/10* (2006.01)

(52) U.S. Cl. ..... 15/410; 15/351

(58) Field of Classification Search ..... 15/410, 15/411, 351; *A47L 9/10*
See application file for complete search history.

(56) References Cited

U.S. PATENT DOCUMENTS

| | | | | |
|---|---|---|---|---|
| 368,052 | A | 8/1887 | Batts | |
| 2,037,668 | A | 4/1936 | Smith et al. | |
| 2,039,860 | A * | 5/1936 | Watts | 15/413 |
| 2,218,160 | A * | 10/1940 | Becker | 15/410 |
| 2,397,537 | A * | 4/1946 | Coss | 15/410 |
| 2,946,071 | A | 7/1960 | Nilsson | |
| 3,031,710 | A | 5/1962 | Huening, Jr. | |
| 3,766,347 | A | 10/1973 | Brooks et al. | |
| 4,052,767 | A | 10/1977 | Dulcher | |
| 4,163,302 | A | 8/1979 | Iaboni | |
| 4,809,393 | A | 3/1989 | Goodrich et al. | |
| 5,134,752 | A * | 8/1992 | Shipman | 15/412 |
| 5,184,371 | A | 2/1993 | Rands | |
| 5,353,468 | A | 10/1994 | Yap et al. | |
| 5,647,090 | A | 7/1997 | Yang | |
| 5,651,558 | A | 7/1997 | Boyce | |
| 5,839,156 | A | 11/1998 | Park et al. | |
| 5,867,862 | A * | 2/1999 | Ahlf et al. | 15/329 |
| 5,996,175 | A * | 12/1999 | Fusco | 15/410 |
| 6,484,349 | B1 | 11/2002 | Paterson et al. | |
| 7,000,285 | B2 | 2/2006 | Conner et al. | |
| 7,194,784 | B2 | 3/2007 | Overvaag et al. | |
| 7,411,133 | B2 * | 8/2008 | Morgan et al. | 174/135 |
| 2010/0175218 | A1 * | 7/2010 | Hawkins et al. | 15/347 |

FOREIGN PATENT DOCUMENTS

| | | |
|---|---|---|
| GB | 2 271 275 | 4/1994 |
| GB | 2 448 745 | 10/2008 |

* cited by examiner

*Primary Examiner* — David Redding
(74) *Attorney, Agent, or Firm* — King & Schickli, PLLC

(57) ABSTRACT

A floor cleaning appliance includes a body having a nozzle assembly and a handle assembly. A dirt collection vessel and suction generator are carried on the body. The handle assembly is pivotally connected to the nozzle assembly and is selectively displaceable into and out of a home position. A latch locks the handle assembly in the home position. An actuator carried on the handle assembly, remote from the latch, releases the latch to allow the handle assembly to be moved from the home position.

16 Claims, 7 Drawing Sheets

ACCESSIBLE VACUUM CLEANER FOR PERSONS WITH DISABILITIES

This application claims the benefit of U.S. Provisional Patent Application Ser. No. 61/047,255 filed on 23 Apr. 2008.

TECHNICAL FIELD AND INDUSTRIAL APPLICABILITY OF THE INVENTION

The present invention relates generally to the floor care equipment field and, more particularly, to a floor cleaning appliance such as a vacuum cleaner particularly adapted for use by individuals with disabilities.

BACKGROUND OF THE INVENTION

Floor care appliances such as upright vacuum cleaners have long been known in the art to be useful in cleaning dirt and debris from floors and the like. Generally such vacuum cleaners are not suited for use by individuals with disabilities that restrict them to movement in a wheelchair. The present invention relates to a vacuum cleaner particularly adapted for use by such individuals.

SUMMARY OF THE INVENTION

In accordance with the purposes of the present invention as described herein, a floor cleaning appliance is provided comprising a body including a nozzle assembly, a suction inlet carried on the nozzle assembly and a handle assembly pivotally connected to the nozzle assembly and selectively displaceable into and out of a home position. The floor cleaning appliance also includes a dirt collection vessel and a suction generator, both of which are carried on the body. A latch is provided for locking the handle assembly in the home position. Further, an actuator is carried on the handle assembly remote from the latch. The actuator releases the latch to allow the handle assembly to be moved from the home position.

In accordance with additional aspects of the present invention the handle assembly is telescopic. Further, a hand grip is carried on the handle assembly. The hand grip rotates on the handle assembly about an arc of at least 40 degrees and more typically about an arc of substantially 90 degrees. This allows ease of use when moving the vacuum cleaner to and fro from a seated position such as from a wheelchair.

In addition the floor cleaning appliance includes an electrical power cord. In one possible embodiment the electrical power cord extends through the end of the hand grip. In another possible embodiment a clip is provided on the hand grip. The clip receives and holds the electrical power cord. In either of these embodiments the location of the power cord extending from the appliance adjacent the end of the handle ensures that the power cord does not become entangled with the wheels of a wheelchair;

More specifically describing the invention, the floor cleaning appliance includes a linkage connecting the actuator with the latch. In one possible embodiment the linkage is mechanical. More specifically, the latch includes a spring loaded locking pin that is carried on either the handle assembly or the nozzle assembly. That locking pin is received in a cooperating receiver carried on the other of the handle assembly and the nozzle assembly to thereby lock the handle assembly in the home position. The home position is typically an upright storage position. In this embodiment the linkage may be a cable so that when the actuator is used, the locking pin is withdrawn from the aperture thereby releasing the handle assembly from the home position.

In an alternative embodiment the linkage is electrical. In this case the spring loaded locking pin is controlled by an electrical solenoid. Lead wires extend between the actuator and the solenoid. When the actuator is used, the solenoid is electrically activated and the locking pin is withdrawn from the receiver to release the handle assembly from the home position. When released the handle assembly pivots freely with respect to the nozzle assembly so as to allow the operator to freely move the vacuum cleaner back and forth in order clean a floor.

In accordance with an alternative embodiment, the handle assembly includes an arcuate rack and an adjustable hand grip is received on that rack. More specifically, the rack includes a series of notches and the adjustable hand grip includes a latching pin received in one of the series of notches to lock the hand grip into a select position on the rack. In one particularly unique embodiment the rack is circular in shape.

In the following description there is shown and described several preferred embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiments of the invention, examples of which are illustrated in the accompanying drawings.

DETAILED DESCRIPTION OF THE PREFERRED EMBODIMENTS OF THE INVENTION

Figure 1:
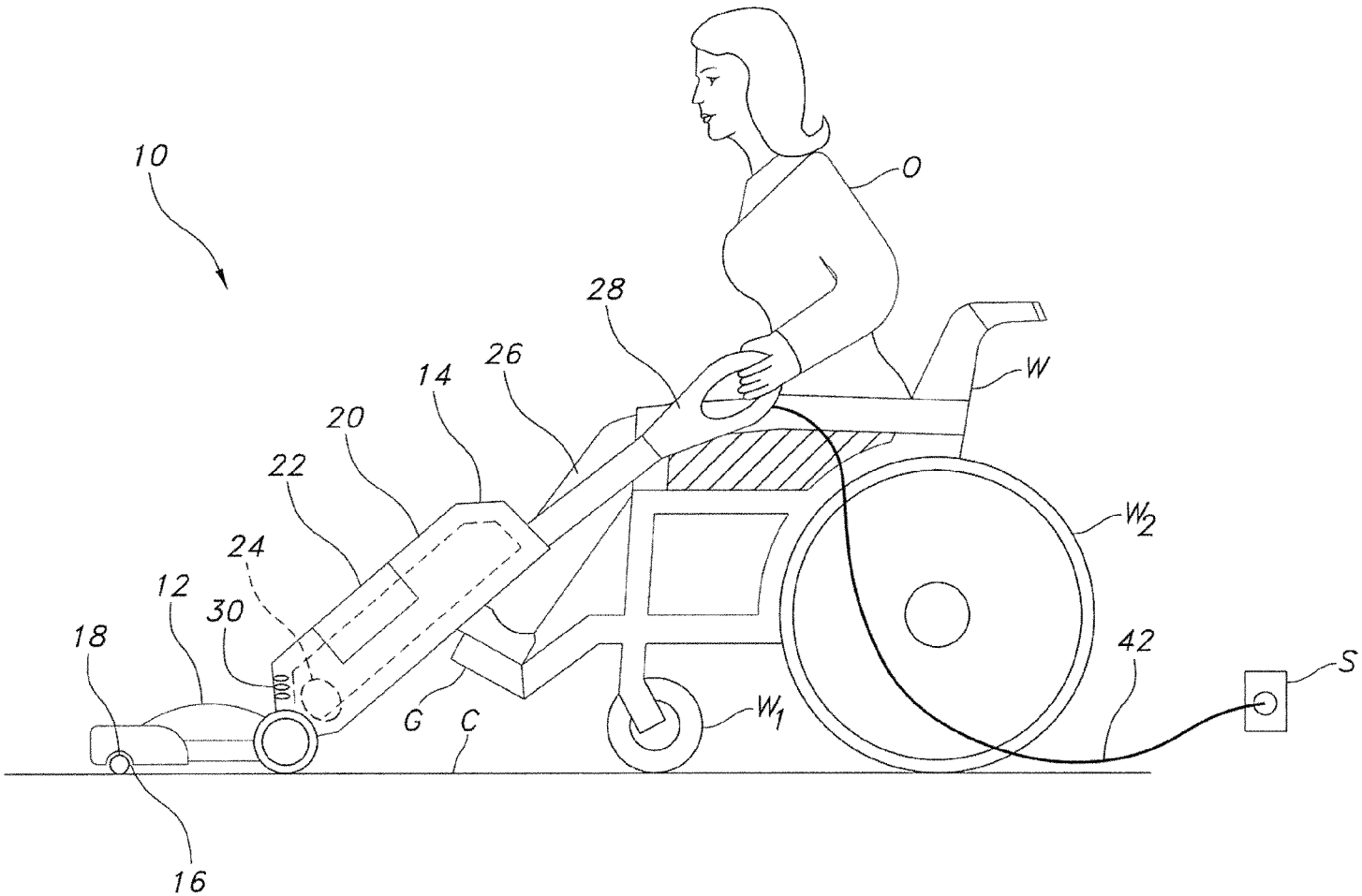
FIG. 1 is a partial schematical side elevational view illustrating the electrical appliance of the present invention being used by an operator in a wheel chair.

Reference is now made to FIG. 1 illustrating the electrical appliance 10 of the present invention. In the illustrated embodiment the electrical appliance 10 takes the form of an upright vacuum cleaner having a body including a nozzle assembly 12 and a handle assembly 14. As illustrated, the nozzle assembly 12 includes a suction inlet 16 and a rotary agitator 18. The rotary agitator 18 includes bristles, brushes, beater bars or other cleaning members to beat dirt and debris from a nap of an underlying carpet provided on the floor F.

The handle assembly 14 includes a housing 20 that houses a dirt collection vessel 22 and a suction generator 24. In addition, the handle assembly 14 includes a telescoping handle section 26 and a hand grip 28.

During vacuum cleaner operation, the rotary agitator 18 beats dirt and debris from the nap of a carpet C resting on the floor. Simultaneously, the suction generator 24 draws that dirt and debris into the vacuum cleaner through the suction inlet 16. The dirt and debris, now entrained in an air stream, is delivered to the dirt collection vessel 22. Dirt and debris is collected in the vessel 22 while relatively clean air is then drawn through and over the suction generator 24 before being exhausted through a final filter such as a HEPA filter (not shown) back into the environment through an exhaust port 30.

In the illustrated embodiment, the dirt collection vessel 22 takes the form of a dirt cup. Such a dirt cup 22 may include a tangentially directed inlet and an axially directed outlet covered by a primary filter. This type of arrangement, well known in the art, provides cyclonic air flow for added cleaning action. It should be appreciated, however, that the invention includes still other embodiments and the dirt collection vessel 22 could take the form of a standard vacuum cleaner filter bag of a type well known in the art held in an enclosed compartment in the housing 20.

Figure 2:
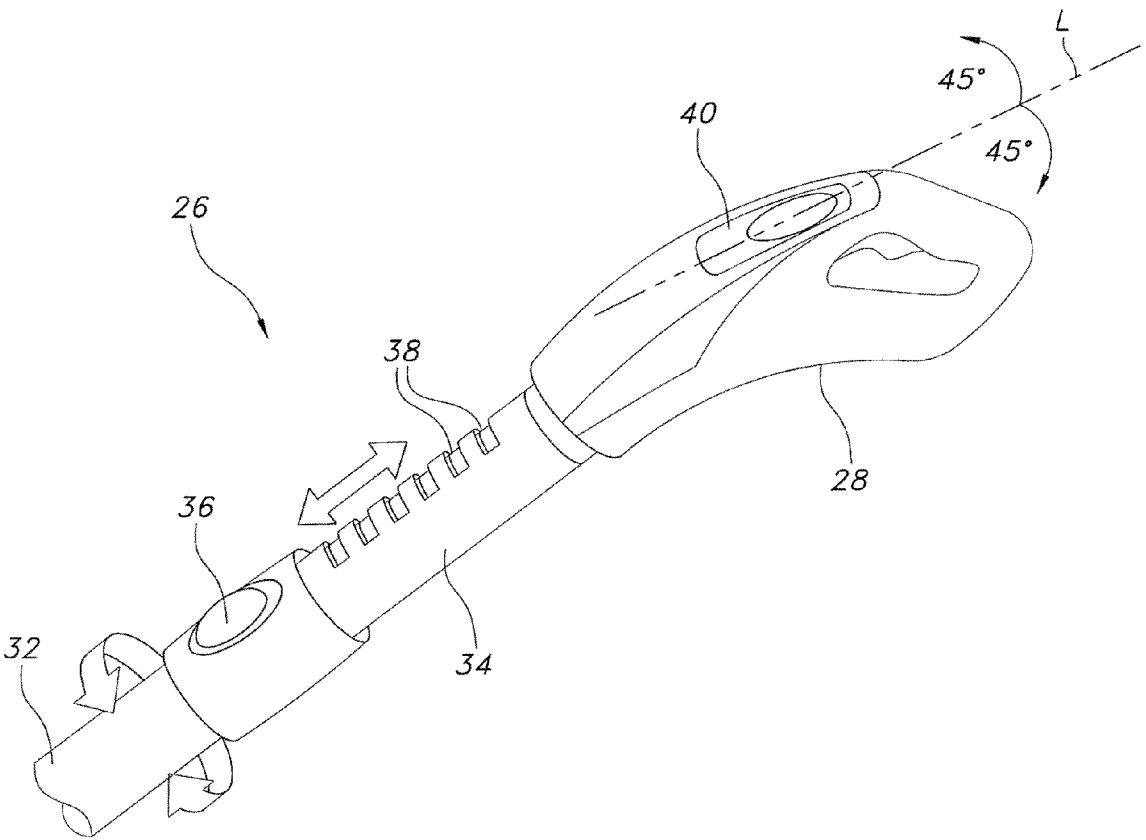
FIG. 2 is a detailed perspective view illustrating the telescoping handle assembly and a rotating hand grip.

As best illustrated in FIG. 2, telescoping handle 26 includes a first or outer tubular section 32, a second or inner tubular section 34 telescopingly received in the outer section 32 and a control actuator 36. In the illustrated embodiment the control actuator 36 is secured to the outer tubular section 32. As illustrated, a series of notches 38 are provided on the inner tubular section 34. Actuator 36 includes a pin (not shown) that may be received in any one of the notches 38. In operation, actuator 36 is depressed to release the pin from a notch 38. The tubular section 34 is then retracted into the outer tubular section 32 to shorten the telescoping handle 26 or extended from the tubular section 32 to lengthen the telescoping handle 26. Once the telescoping handle 26 is provided at the desired length, the actuator 36 is released. The locking pin of the actuator 36 then engages the appropriate notch 38 to secure the telescoping handle 26 at the desired length in a manner known in the art.

As further illustrated in FIG. 2, hand grip 28 is secured on the distal end of the inner tubular section 34. The connection allows the hand grip 28 to rotate freely about the telescoping handle 26 through an arc of at least 40 degrees and more typically an arc of substantially 90 degrees. Thus, as illustrated, the hand grip 28 rotates 45 degrees clockwise and counterclockwise from a center line position L wherein the control switches 40 provided on the hand grip 28 are aligned with the actuator 36 and the top of the nozzle assembly 12. This rotational or pivotal movement of the hand grip 28 relative to the telescoping handle 26 compliments movement of the wrist as the vacuum cleaner 10 is guided to and fro when the operator O is seated in the wheelchair W. It should be appreciated that the handle 26 will extend about 32 to about 34 inches in length. This is about 8 to about 10 inches longer than a standard upright vacuum cleaner handle. The extra length allows the operator O to more easily reach beyond the wheel chair W, including particularly the foot supports G (see FIG. 1), and greatly assists in the cleaning of a work space.

Figure 3:
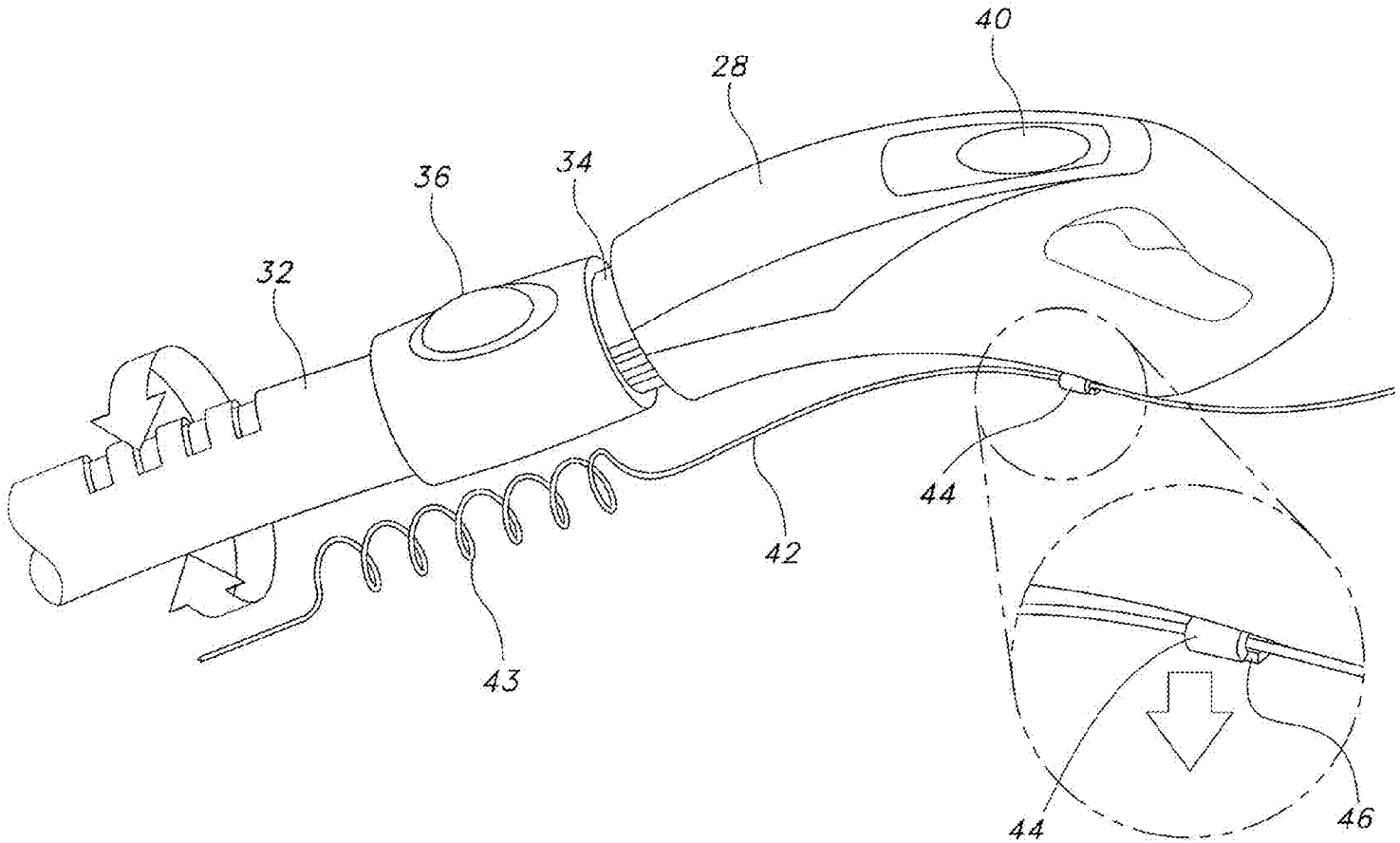
FIG. 3 is a detailed perspective view illustrating the clip for holding the power cord provided on the hand grip.

As illustrated in FIG. 1, the electric appliance 10 also includes a power cord 42 that may be connected to a standard electrical wall outlet S. That power cord 42 may extend from the end of the hand grip 28. This arrangement allows the power cord 42 to be held up and away from the wheels W1, W2 of the wheel chair W. In an alternative embodiment illustrated in FIG. 3, the hand grip 28 includes a clip 44 made from resilient material. Clip 44 includes a slot 46. Power cord 42 is passed through the slot 46 where it is held in the clip 44 adjacent the hand grip 28. This alternative arrangement also ensures that the power cord 42 is held up off the floor F away from the wheels W1, W2 of the wheelchair W so the cord will not become entangled with the wheels or interfere with the ability of the operator O to freely move the wheelchair W across the floor. As illustrated, the power cord 42 may also include crimping 43 to accommodate movement of the handle 26 and hand grip 28 (including telescoping movement).

The handle assembly 14 of the upright vacuum cleaner 10 is pivotally connected to the nozzle assembly 12. This allows the operator to freely move the nozzle assembly 12 back and forth across the floor without lifting the nozzle assembly from the floor. In fact, the potential for lifting the nozzle assembly 12 from the floor can be further reduced by spring loading the nozzle assembly 12 to produce a down force in accordance with the teachings of U.S. Pat. No. 6,772,475.

Figure 4:
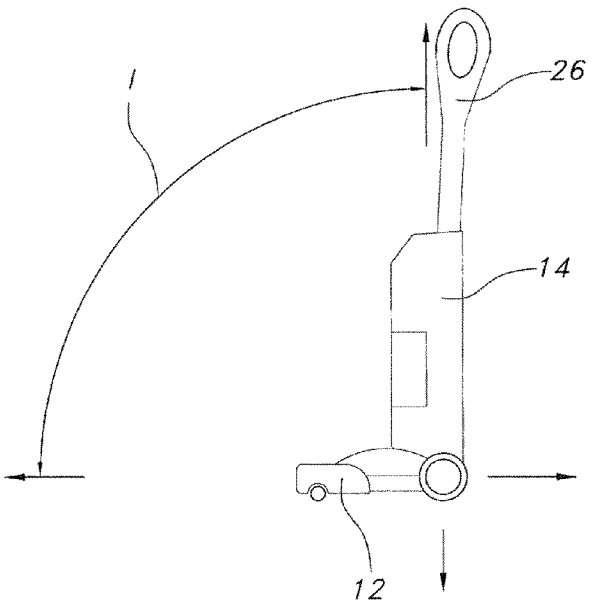
FIG. 4 is a side elevational view illustrating the handle assembly in the home or storage position.

As illustrated in FIG. 4 the vacuum cleaner 10 of the present invention includes a handle assembly 14 that may be positioned in a home or upright storage position wherein the handle assembly and nozzle assembly define an included angle I of approximately 85 to 90 degrees. In this position the hand grip 28 is held up high for ready access by the operator O in the wheelchair W. At the same time the weight of the handle assembly 14 is substantially centered over the nozzle assembly 12 when that nozzle assembly is resting flat on the floor F. This helps prevent the inadvertent tipping over of the vacuum cleaner 10.

Figure 5:
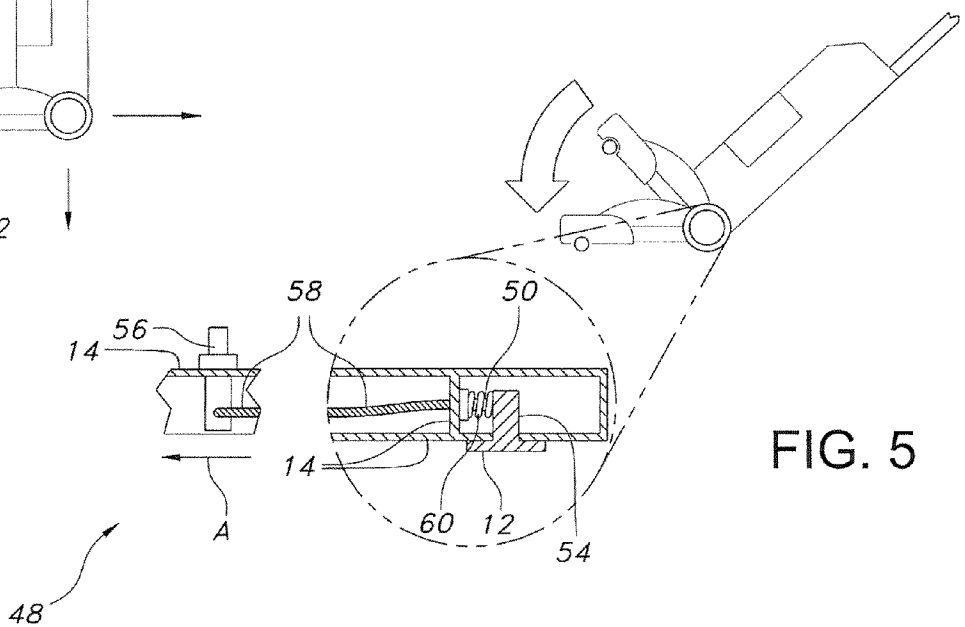
FIG. 5 is detailed schematical view illustrating a mechanical linkage provided between the actuator and latch.
Figure 6:
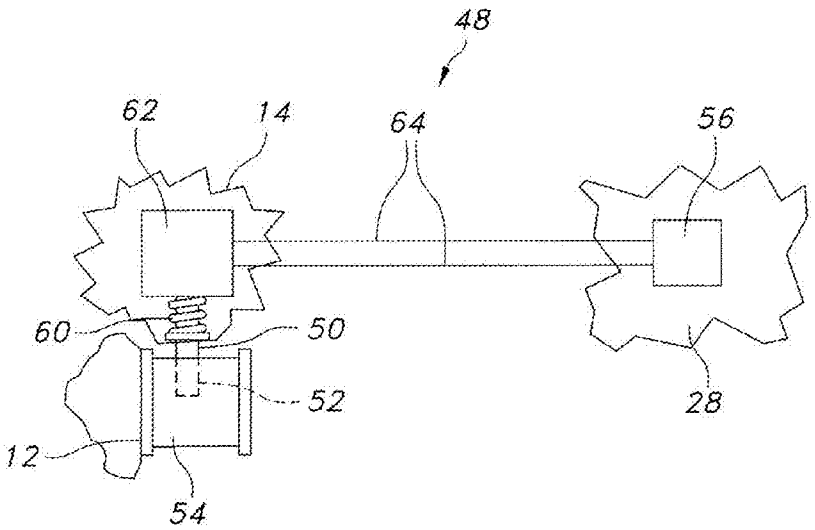
FIG. 6 is a schematical illustration of the electrical linkage provided between the actuator and latch.

As illustrated in FIGS. 5 and 6, the handle assembly 14 is secured or locked in the home position by means of a latch mechanism, generally designated by reference numeral 48. More specifically, the latch mechanism 48 includes a spring loaded locking pin 50 carried on the handle assembly 14. The distal end of the spring loaded locking pin 50 is received in a cooperating slot or aperture 52 provided in one of the two opposing bushings or trunions carried on the nozzle assembly 12 that, pivotally interconnect the nozzle assembly 12 and handle assembly 14.

As illustrated in FIGS. 5 and 6, the electrical appliance 10 also includes an actuator 56 for releasing the latch mechanism 48 to allow the handle assembly 12 to be moved from the home position. The actuator 56 is illustrated as a sliding button in FIG. 5 and a push button in FIG. 6. The actuator 56 is mounted to the handle assembly 14. Typically the actuator 56 is provided on or adjacent to the hand grip 28 where it can be easily accessed and manipulated by the operator O. Accordingly, it should be appreciated that the actuator 56 is provided remote from the latch mechanism 48 which is provided adjacent to the floor F in the area of the bushing 54 interconnecting the nozzle assembly 12 and handle assembly 14.

A linkage connects the actuator 56 with the latch mechanism 48. In the FIG. 5 embodiment the linkage is mechanical in nature. Specifically, a cable 58 interconnects the actuator 56 with the locking pin 50 of the latch mechanism 48. By sliding the actuator 56 in the direction of action arrow A, the locking pin 50 is retracted and withdrawn from the aperture in the bushing 54. This releases the latch mechanism 48 to allow the handle assembly 14 to be freely pivoted with respect to the nozzle assembly 12. When the handle assembly 14 is returned to the home position, the locking pin 50 is again aligned with the slot or aperture 52 in the bushing 54. The spring 60 provided on the spring loaded locking pin 50 then biases the distal end of the locking pin into the slot 52 to thereby once again lock the handle assembly 14 in the home position.

In the embodiment illustrated in FIG. 6, the linkage is electromechanical in nature. The latch mechanism 48 includes an electrical solenoid 62. Electrical lead wires 64 connect the push button actuator 56 to the solenoid 62. The lead wires 64 may be crimped in order to accommodate the telescoping movement of the handle 26. When the push button 56 is depressed, the electrical solenoid 62 is energized and the locking pin 50 is withdrawn from the aperture 52 in the bushing 54. The handle assembly 14 may then be freely pivoted with respect to the nozzle assembly 12 so that the operator O may manipulate the appliance 10 to clean the floor F. When the handle assembly 14 is returned to the home position, the spring 60 biases the locking pin 50 back into the aligned slot 52 so as to engage the bushing 54 and secure the handle assembly once again in the home position.

Figure 7:
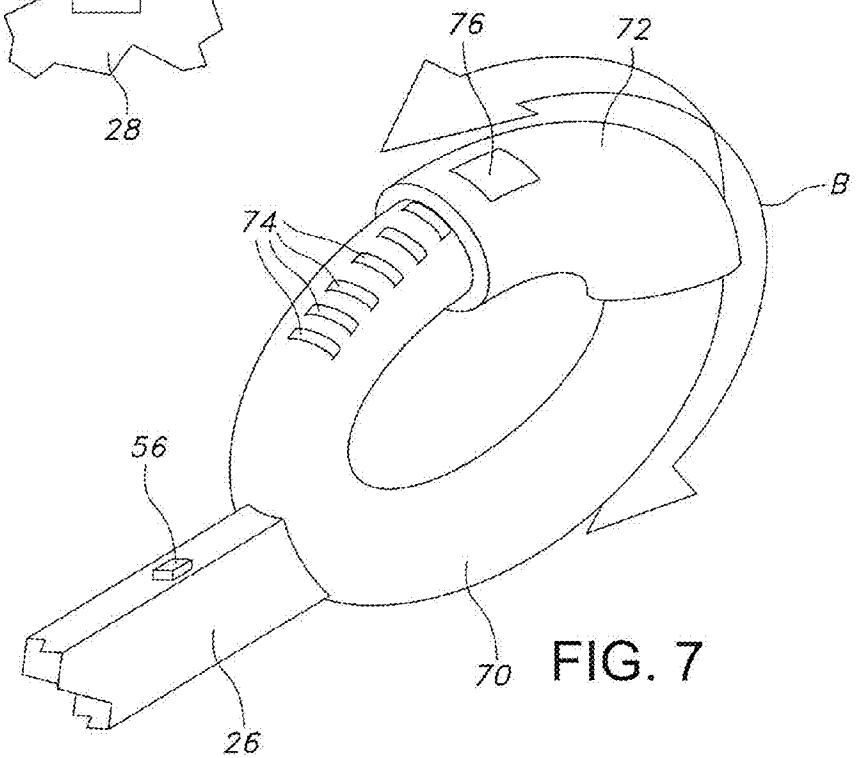
FIG. 7 is a detailed perspective view illustrating an alternative embodiment of the handle assembly.
Figure 8:
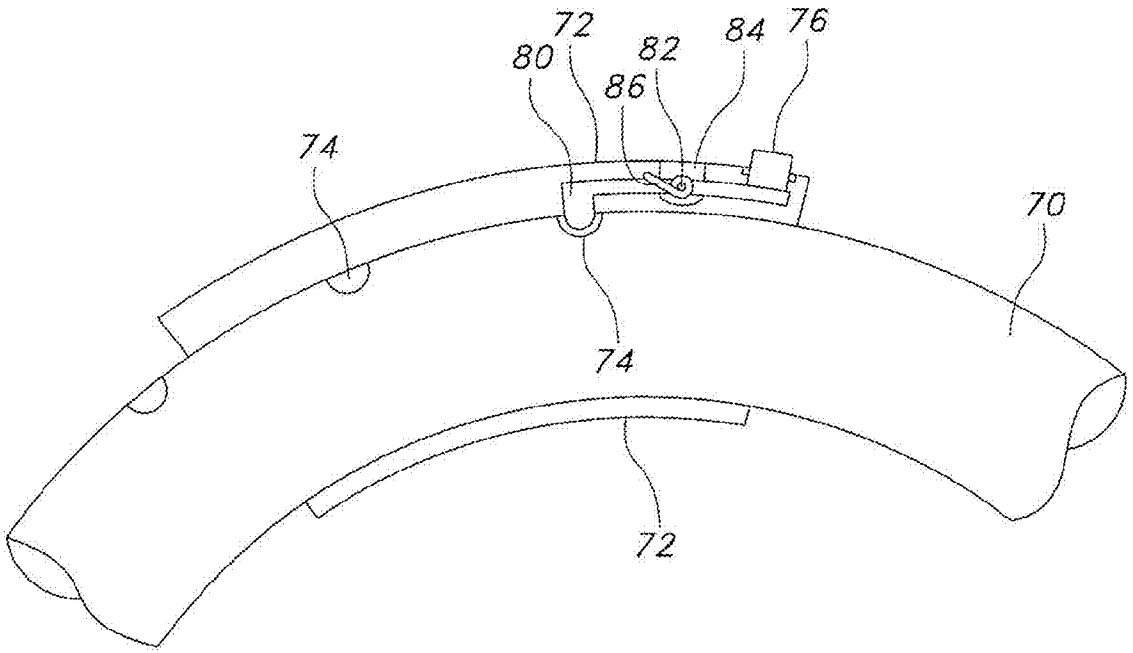
FIG. 8 is a schematical side view illustrating the hand grip locked in position on the rack.
Figure 9:
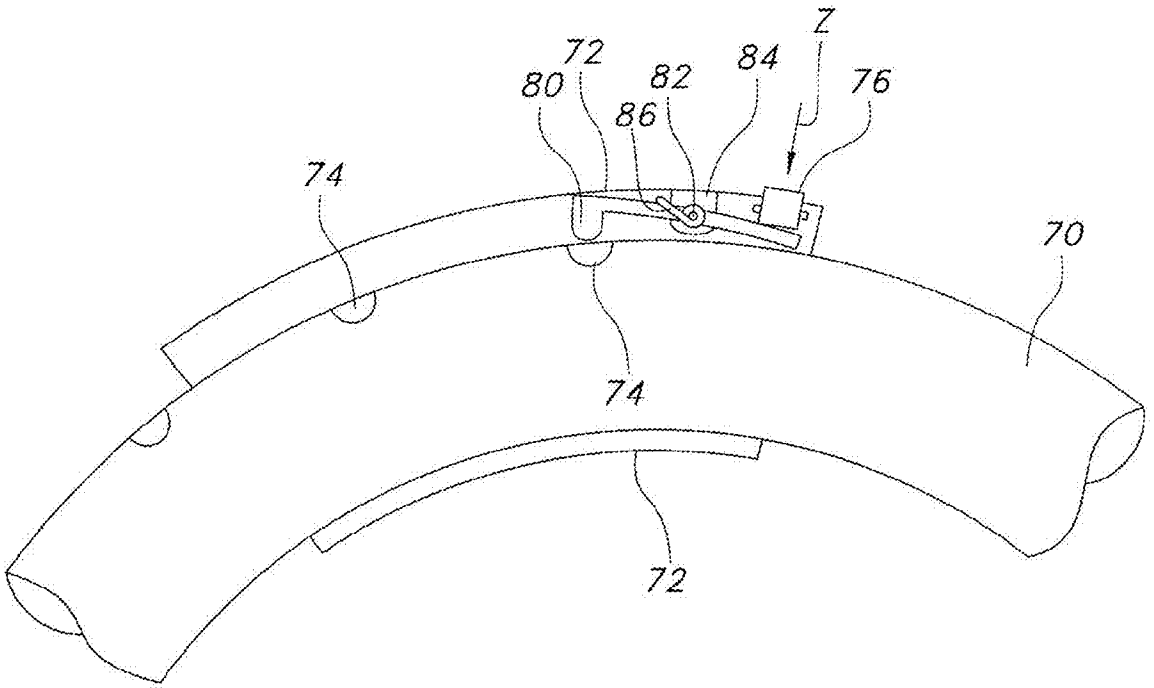
FIG. 9 is a schematical side view illustrating the pin released from the notch to allow the hand grip to be moved along the rack.

An alternative embodiment of the handle assembly is illustrated in FIG. 7. In this embodiment the handle assembly includes an arcuate rack 70. In the illustrated embodiment the arcuate rack 70 forms a complete circle. It should be appreciated, however, that the arcuate rack 70 may form any portion or arc of a complete circle as desired. A hand grip 72 is received for free sliding movement along the rack. Specifically, the hand grip 72 includes a radius of curvature matching the radius of curvature of the rack 70. Notches 74 are provided at spaced positions along the rack 70. A latching mechanism is provided on the hand grip 72. The latching mechanism incorporates an actuator 76 connected to a pin 80. During normal operation, the pin 80 is engaged in one of the notches 74 in order to hold the hand grip 72 in position on the rack 70 (see FIG. 8). When the operator O desires to adjust the position of the hand grip 72, the actuator 76 is depressed (see action arrow Z in FIG. 9). This causes the pin 80 to pivot about the stub shaft 82 held in a lug 84 on the hand grip 72, until the pin is removed from the notch 74 so that the hand grip 72 slides freely over the rack 70 (note FIG. 9 and action arrow B in FIG. 7). Once the hand grip 72 is positioned as desired along the rack 70 by the operator O, the operator releases the actuator 76. The pin 80 is then biased by a torsion spring 86 so as to enter and engage the aligned notch 74 to once again secure the hand grip 72 in position on the rack 70.

The foregoing description of the preferred embodiments of the present invention have been presented for purposes of illustration and description. It is not intended to be exhaustive or to limit the invention to the precise form disclosed. Obvious modifications or variations are possible in light of the above teachings. For example, the locking pin 50 of the latch 48 may be carried on the nozzle assembly 12 and engage a locking aperture or receiver 52 carried on the handle assembly 14. Further, it should be appreciated that the vacuum cleaner 10 could be a battery powered unit thereby eliminating the need for a power cord 42. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor cleaning appliance, comprising:

a body including a nozzle assembly, a suction inlet carried on said nozzle assembly and a handle assembly pivotally connected to said nozzle assembly and selectively displaceable into and out of a home position;

a dirt collection vessel carried on said body;

a suction generator carried on said body;

a latch locking said handle assembly in said home position; and an actuator carried on said handle assembly remote from said latch, said actuator releasing said latch to allow said handle assembly to be moved from said home position;

said handle assembly being further characterized by including an arcuate rack and having an adjustable hand grip received on said rack where said rack includes a series of notches and said adjustable hand grip includes a latching pin received in one of said series of notches to lock said hand grip into a selected position on said rack.

2. The appliance of claim 1, wherein said handle assembly is telescoping.

3. The appliance of claim 1, wherein said rack is circular.

4. The appliance of claim 1, further including a linkage connecting said actuator and said latch.

5. The appliance of claim 4, wherein said linkage is mechanical.

6. The appliance of claim 4, wherein said latch includes a spring loaded locking pin carried on one of said handle assembly and said nozzle assembly that is received in a cooperating locking pin receiver carried on the other of said handle assembly and said nozzle assembly.

7. The appliance of claim 6, wherein said linkage is a cable.

8. floor cleaning appliance, comprising:

a body including a nozzle assembly, a suction inlet carried on said nozzle assembly and a telescoping handle assembly privotally connected to said nozzle assembly and selectively displaceable into and out of a home position;

a dirt collection vessel carried on said body;

a suction generator carried on said body;

a latch locking said handle in said home position; and an actuator carried on said handle assembly remote from said latch to allow said handle assembly to be moved from said home position;

said latch further including a solenoid connected to said actuator whereby telescoping movement of said telescoping handle assembly is accommodated by said latch.

9. The appliance of claim 8, wherein a linkage includes lead wires connecting said actuator and said solenoid.

10. The appliance of claim 8, further including a hand grip carried on said handle assembly.

11. The appliance of claim 10, wherein said hand grip rotates on said handle assembly.

12. The appliance of claim 11, wherein said hand grip rotates about an arc of at least 40 degrees.

13. The appliance of claim 11, wherein said hand grip rotates about an arc or substantially 90 degrees.

14. The appliance of claim 11, further including an electrical power cord.

15. The appliance of claim 14, wherein said electrical power cord extends through said hand grip.

16. The appliance of claim 14, further including a clip on said hand grip that receives and holds said electrical power cord.

* * * * *